US007819599B2

(12) United States Patent
Kobayashi et al.

(10) Patent No.: US 7,819,599 B2
(45) Date of Patent: Oct. 26, 2010

(54) CUTTING DEVICE FOR TAPE PRINTING APPARATUS

(75) Inventors: Shinji Kobayashi, Tokai (JP); Keiji Seo, Nagoya (JP); Akira Sago, Seto (JP); Atsushi Kasugai, Nagoya (JP); Hiroaki Kita, Nagoya (JP)

(73) Assignee: Brother Kogyo Kabushiki Kaisha, Nagoya-Shi (JP)

( * ) Notice: Subject to any disclaimer, the term of this patent is extended or adjusted under 35 U.S.C. 154(b) by 550 days.

(21) Appl. No.: 11/900,070

(22) Filed: Sep. 10, 2007

(65) Prior Publication Data

US 2008/0069623 A1 Mar. 20, 2008

(30) Foreign Application Priority Data

Sep. 15, 2006 (JP) ..... 2006-250799

(51) Int. Cl.
*B41J 11/70* (2006.01)

(52) U.S. Cl. ..... 400/621; 400/646

(58) Field of Classification Search ..... 400/621, 400/646; 88/166

See application file for complete search history.

(56) References Cited

U.S. PATENT DOCUMENTS

| | | | | |
|---|---|---|---|---|
| 5,232,293 | A * | 8/1993 | Hibon et al. | 400/105 |
| 5,468,081 | A * | 11/1995 | Cane et al. | 400/621 |
| 6,118,469 | A | 9/2000 | Hosomi | |
| 6,148,708 | A * | 11/2000 | Pfeiffer | 83/628 |
| 6,652,173 | B1 * | 11/2003 | Martini et al. | 400/621 |
| 7,033,094 | B2 * | 4/2006 | Imai | 400/621 |
| 7,097,373 | B2 * | 8/2006 | Mochizuki et al. | 400/621 |
| 2002/0056354 | A1 | 5/2002 | Morita | |
| 2006/0137827 | A1 | 6/2006 | Uneyama | |

FOREIGN PATENT DOCUMENTS

| | | | |
|---|---|---|---|
| EP | 1 541 363 | A | 6/2005 |
| EP | 1 559 566 | A | 8/2005 |
| JP | 10100493 | A * | 4/1998 |
| JP | 11 000892 | A | 1/1999 |
| JP | 2002086823 | | 3/2002 |
| JP | 2002338130 | A * | 11/2002 |
| JP | 2003225887 | A * | 8/2003 |
| JP | 2003311676 | A * | 11/2003 |

* cited by examiner

*Primary Examiner*—Daniel J Colilla
(74) *Attorney, Agent, or Firm*—Day Pitney LLP

(57) ABSTRACT

There is provided a tape printing apparatus capable of improving durability performance of a cutting mechanism constituted of a fixed blade and a movable blade tremendously. The bottom edge portion of an opening portion in a rear frame is formed to be located below the bottommost end portion of the V-shaped tip of this movable blade by a predetermined height (for example, about 3 mm to 5 mm) when the movable blade is located at the lowest point, that is, a home position. That is, even when the movable blade is located at the lowest point, there is formed a gap of a predetermined distance (for example, a distance of about 3 mm to 5 mm) in the vertical direction between the bottommost end portion of the V-shaped tip of the movable blade and the bottom end edge portion of the opening portion.

3 Claims, 14 Drawing Sheets

CUTTING DEVICE FOR TAPE PRINTING APPARATUS

CROSS-REFERENCE TO RELATED APPLICATIONS

The present application claims priority from JP 2006-250799, filed on Sep. 15, 2006, the disclosure of which is herein incorporated by reference in its entirety.

TECHNICAL FIELD

The disclosure relates to a tape printing apparatus having a cutting device for cutting a long size roll sheet.

BACKGROUND

Conventionally, a variety of tape printing apparatuses having the cutting device for cutting the long size roll sheet throughout its entire width have been proposed. For example, there is available a tape printing apparatus having a slide type cutting device for cutting the roll sheet in the width direction by sliding its movable blade in the width direction of the roll sheet (for example, Japanese Patent Application Laid-open No. 2002-86823).

The slide type described in the above-mentioned Japanese Unexamined Patent Publication No. 2002-86823 includes a cutter carrying mechanism for reciprocating a cutter unit having the movable blade in a cutting direction, so that the movable blade set at the home position is slid and the reciprocating motion of passing a printing medium in the width direction completely is achieved when cutting a printing medium. This cutter carrying mechanism has a problem that it is difficult to form into a thin configuration because it needs to be provided with a guide shaft for guiding the cutter unit and a lead screw which is engaged with the cutter unit to move the cutter. Further, the slide system has a problem that the durability of the movable blade is dropped because cutting points of the movable blade for cutting the roll sheet are concentrated locally.

Thus, a cutting mechanism (so-called guillotine cutter) which cuts the roll sheet with a fixed blade making contact with one side face of the roll sheet throughout the entire width in the width direction and a movable blade which after making contact with the entire width in the width direction on the other side face of the roll sheet, slides on this fixed blade moving in the thickness direction of the roll sheet can be considered. However, in the cutting mechanism comprised of the fixed blade and movable blade, no gap relative to a frame member is secured to protect the movable blade in a condition in which the movable blade is stored. For the reason, if a non-printing object surface of the roll sheet is provided with an adhesive agent layer, there is such a problem that an adhesive agent adheres to the movable blade and when the movable blade slides on the frame member to cut out the roll sheet, sliding resistance is caused thereby dropping durability performance of the cutting mechanism.

SUMMARY

Accordingly, the disclosure has been accomplished to solve the above-described problem and an object of the disclosure is to provide a tape printing apparatus capable of improving durability performance of a cutting mechanism constituted of a fixed blade and a movable blade by preventing an adhesive agent adhering to the movable blade from causing resistance to sliding when the movable blade slides on a frame member.

To achieve the purpose of the disclosure, there is provided a printing apparatus comprising cutting device for cutting a long size roll sheet, wherein the cutting device comprises: a fixed blade which makes a contact with an entire width in a width direction of one side face of the roll sheet; a frame member in which the fixed blade is fixed; a roll sheet insertion port which is formed at a position opposing the fixed blade of the frame member and through which the roll sheet passes; a movable blade which is provided movably in a thickness direction of the roll sheet and after coming into contact with other side face of the roll sheet, moves in the thickness direction while sliding on the fixed blade so as to cut out the roll sheet throughout an entire width in the width direction; and movable blade driving device for reciprocating the movable blade on the frame member in a thickness direction of the roll sheet, wherein the roll sheet contains a printing object medium to be printed by printing device, an adhesive agent layer provided on a non-printing object face of the printing object medium and a peeling layer which covers the adhesive agent layer, and wherein the frame member contains a keep-off spatial portion which is provided on a side edge portion on a side of the movable blade in the roll sheet insertion port so as to avoid contact with an adhesive agent adhering to the movable blade.

Because the keep-off spatial portion for avoiding contact with an adhesive agent adhering to the movable blade is formed on the side edge portion on the side of the movable blade in the roll sheet insertion port, when the movable blade is reciprocated on the frame member, an adhesive agent adhering to the movable blade is prevented from causing resistance to sliding thereby improving durability performance of the cutting mechanism constituted of the fixed blade and the movable blade tremendously.

DETAILED DESCRIPTION

Figure 1:
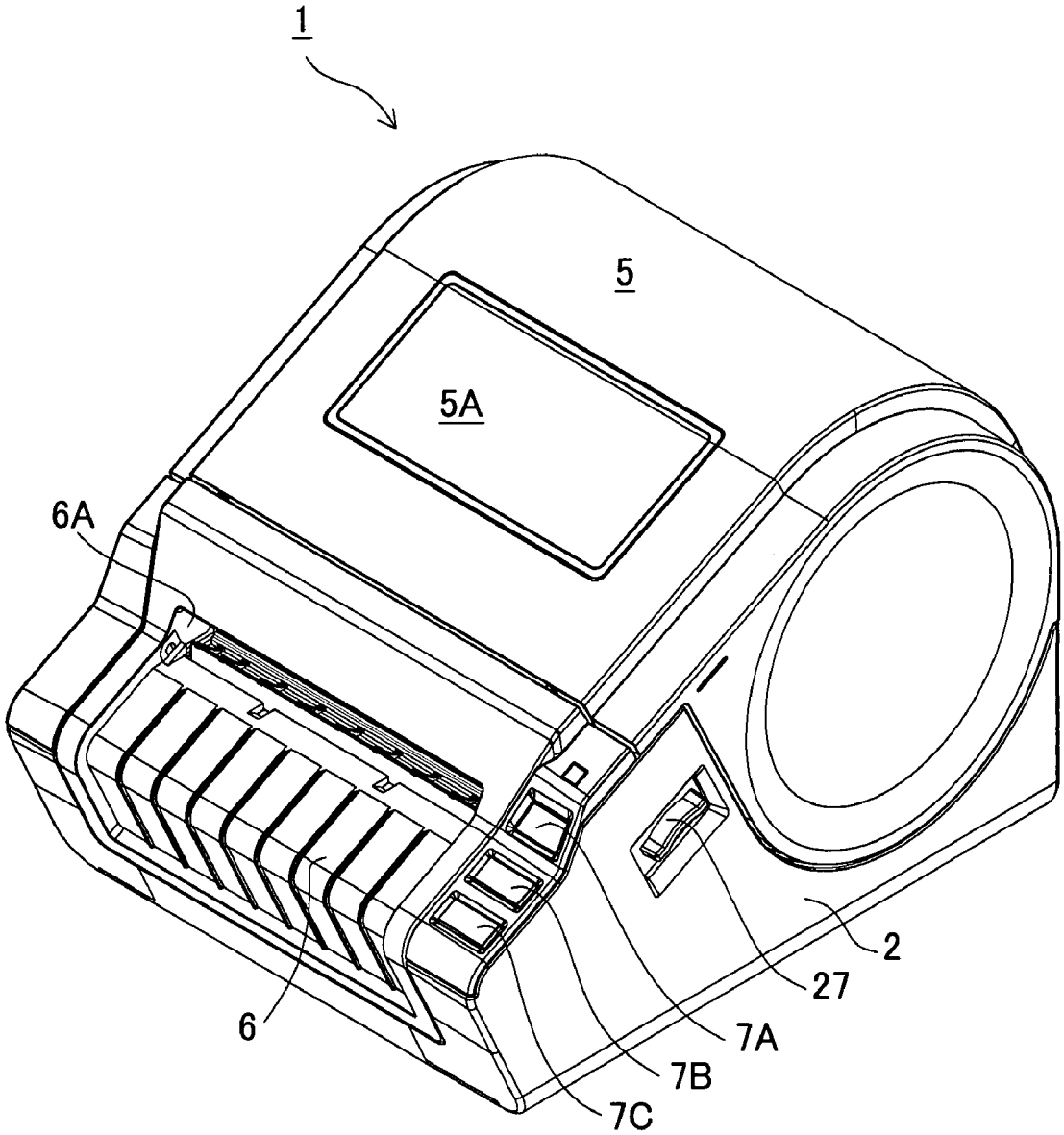
FIG. 1 is a perspective view of an appearance of a tape printing apparatus of this embodiment as seen from its front face.
Figure 2:
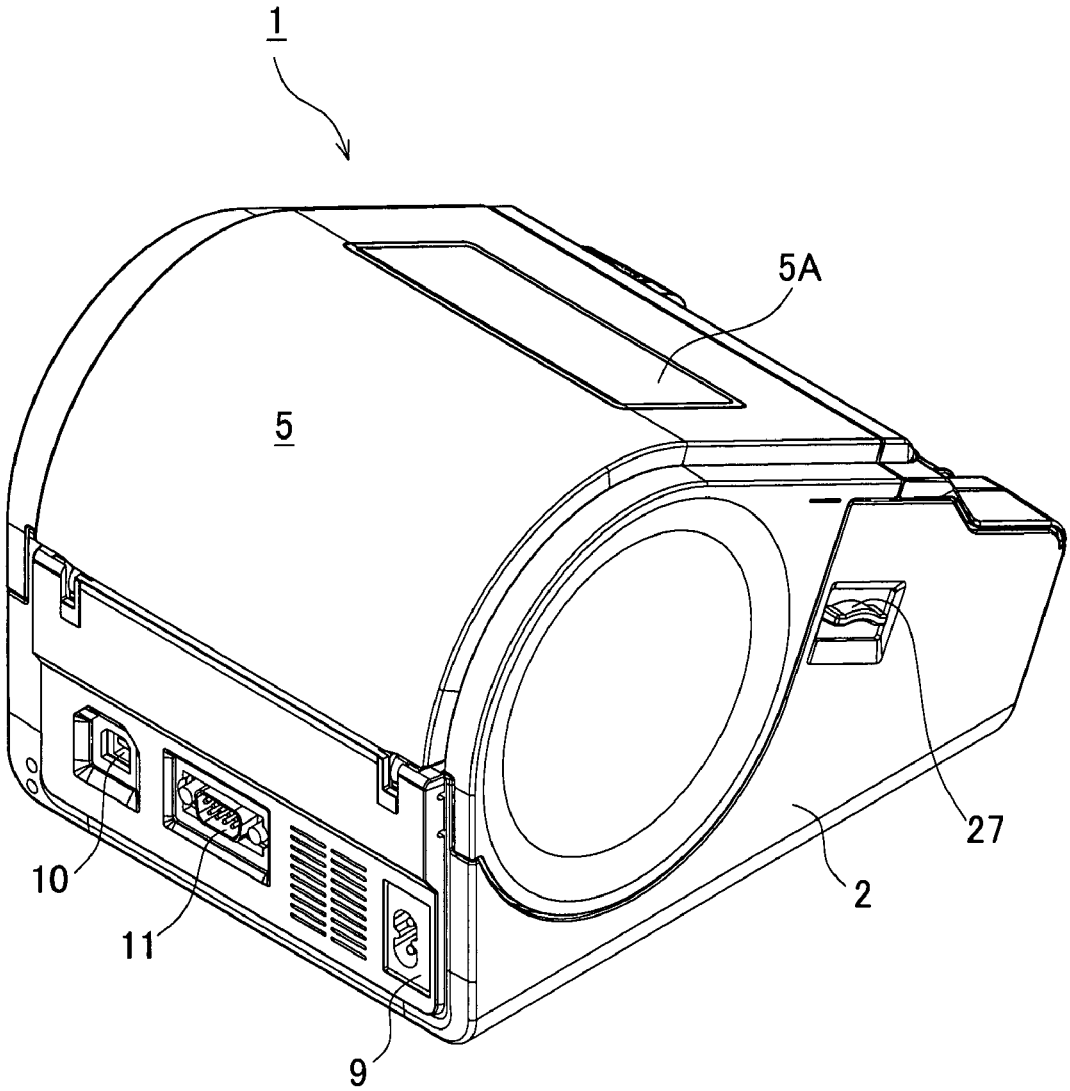
FIG. 2 is a perspective view of an appearance of the tape printing apparatus as seen from its rear face.

Hereinafter, an exemplary embodiment of a tape printing apparatus of the disclosure will be described in detail with reference to the accompanying drawings.

Embodiments

First, the schematic structure of the tape printing apparatus loaded with a roll sheet holder of this embodiment will be described based on FIGS. 1 to 6. As shown in FIGS. 1 to 6, in the tape printing apparatus 1, a main body case 2 and a roll sheet holder 3 on which a non-specified length holder sheet 3A (hereinafter referred to as "roll sheet 3A") of a predetermined width is wound are accommodated in a roll sheet holder accommodating portion 4. The top portion thereof is covered with a top cover 5 made of resin, the cover being attached to the top edge portion on the rear side such that it can be opened/closed freely. A check window 5A made of transparent resin is formed in the top face portion of this top cover 5 so that the roll sheet 3A loaded in the holder accommodating portion 4 can be confirmed visually.

A power button 7A, a feed button 7B for discharging the roll sheet 3A in a carrying direction while it is kept pressed and a cut button 7C for cutting the roll sheet 3A by driving the cutter unit 8 covered with the front cover 6 when it is pressed are provided on a side end portion (right end portion in FIG. 1) on one side of the front side of the upper cover 5. The front cover 6 includes a sheet discharge port 6A for discharging the printed roll sheet 3A outside.

An inlet 9 to which a power cord (not shown) is to be connected is disposed on an end portion on one side of the rear face portion of the main body case 2 and a blower fan (not shown) is disposed on a side thereof. Further, a universal serial bus (USB) connector 10 to be connected to a personal computer (not shown) and a connecting connector 11 are provided on the side portion on the other side.

Figure 5:
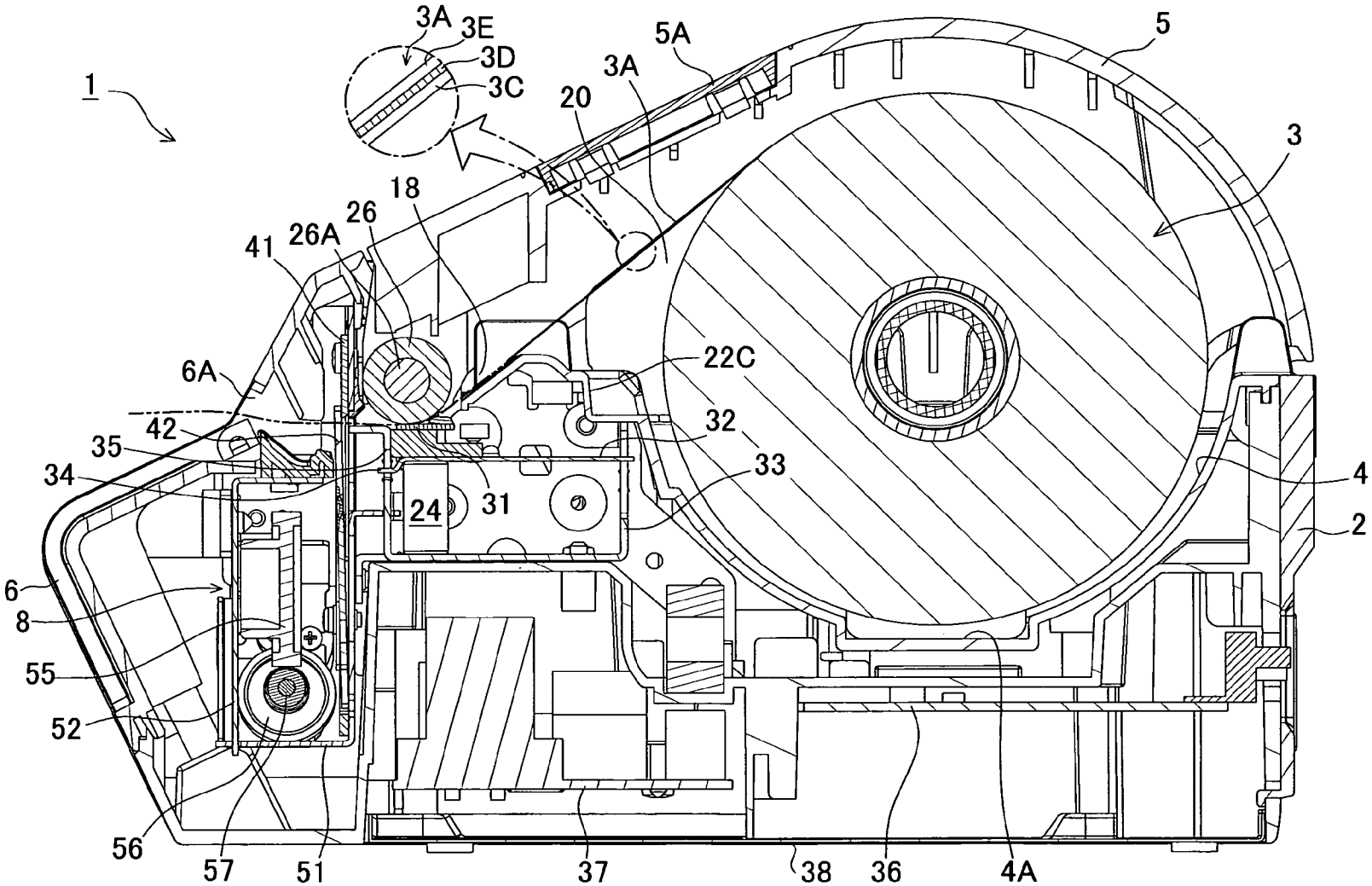
FIG. 5 is a side sectional view showing a condition in which the roll sheet holder is loaded in the tape printing apparatus.

As shown in FIG. 5, this roll sheet 3A is constituted by bonding together long size heat sensitive sheet (so-called thermal paper) 3C having self color generating characteristic and peeling paper 3E via an adhesive agent layer 3D provided on the rear face side of this heat sensitive sheet 3C and wound around such that printing object face of the heat sensitive sheet 3C is located inside.

Figure 3:
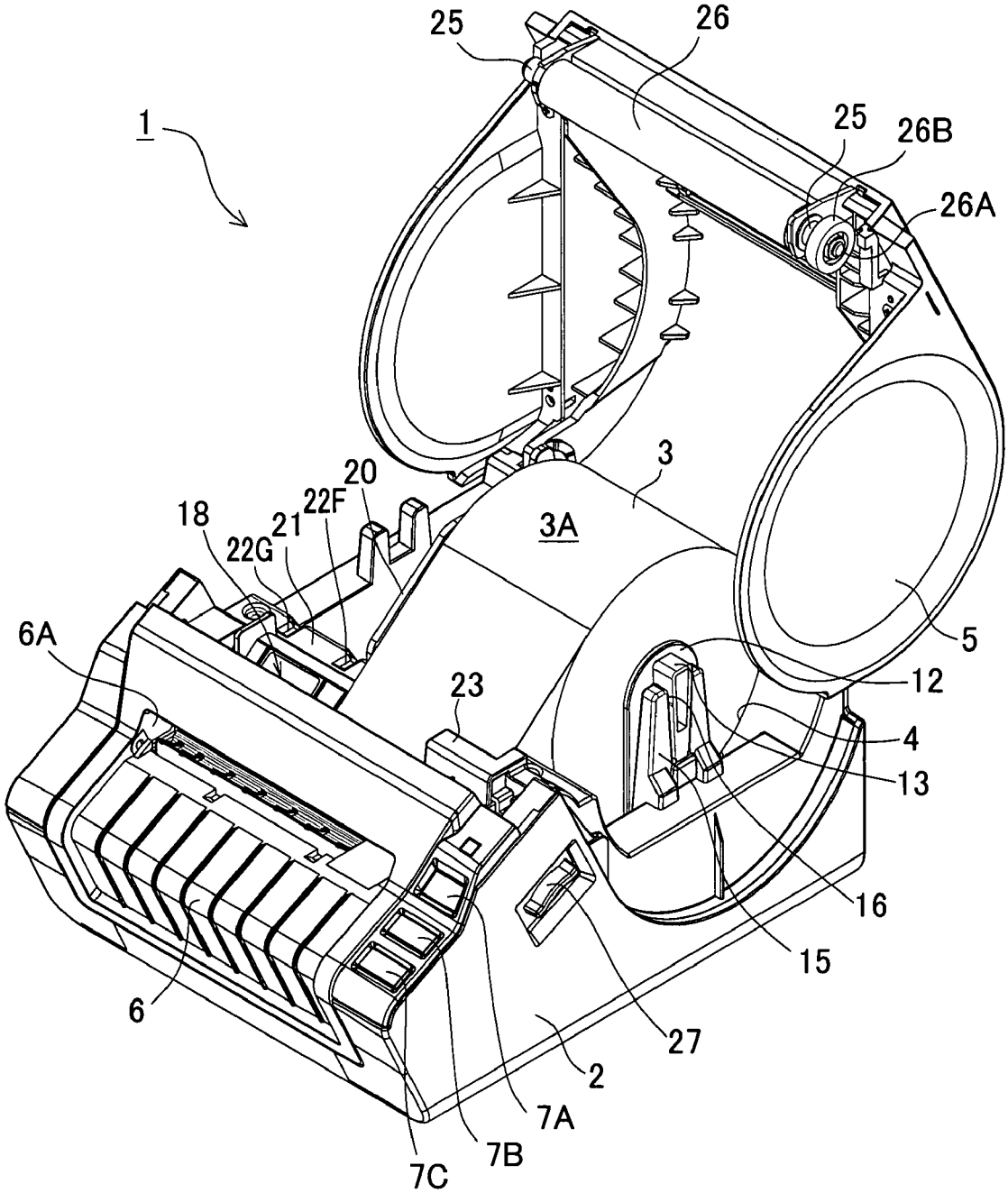
FIG. 3 is a perspective view showing a condition in which a roll sheet holder is loaded in the tape printing apparatus by opening a top cover, as seen from above to the right.
Figure 4:
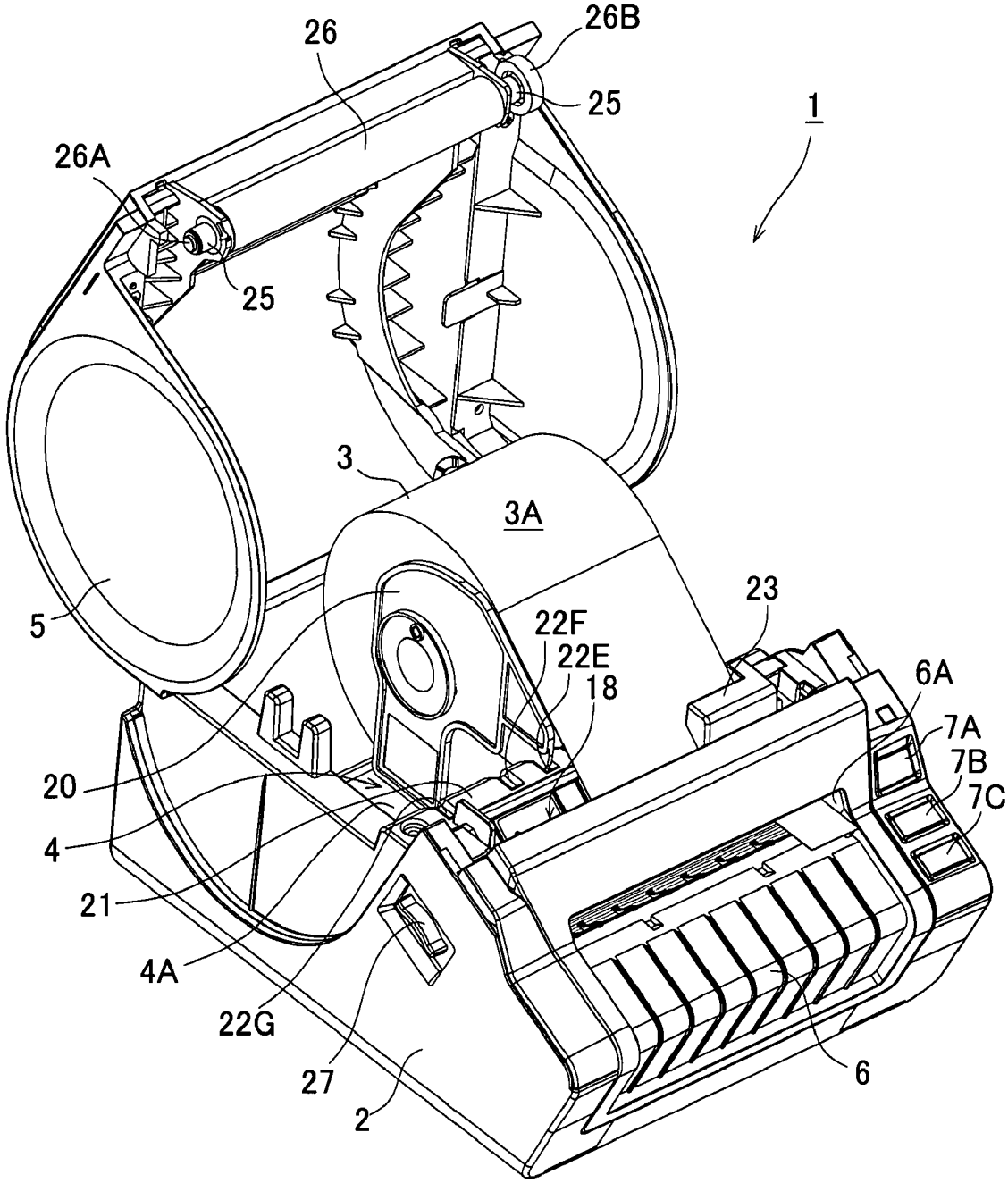
FIG. 4 is a perspective view showing a condition in which the roll sheet holder is loaded in the tape printing apparatus by opening the top cover as seen from above to the left.
Figure 6:
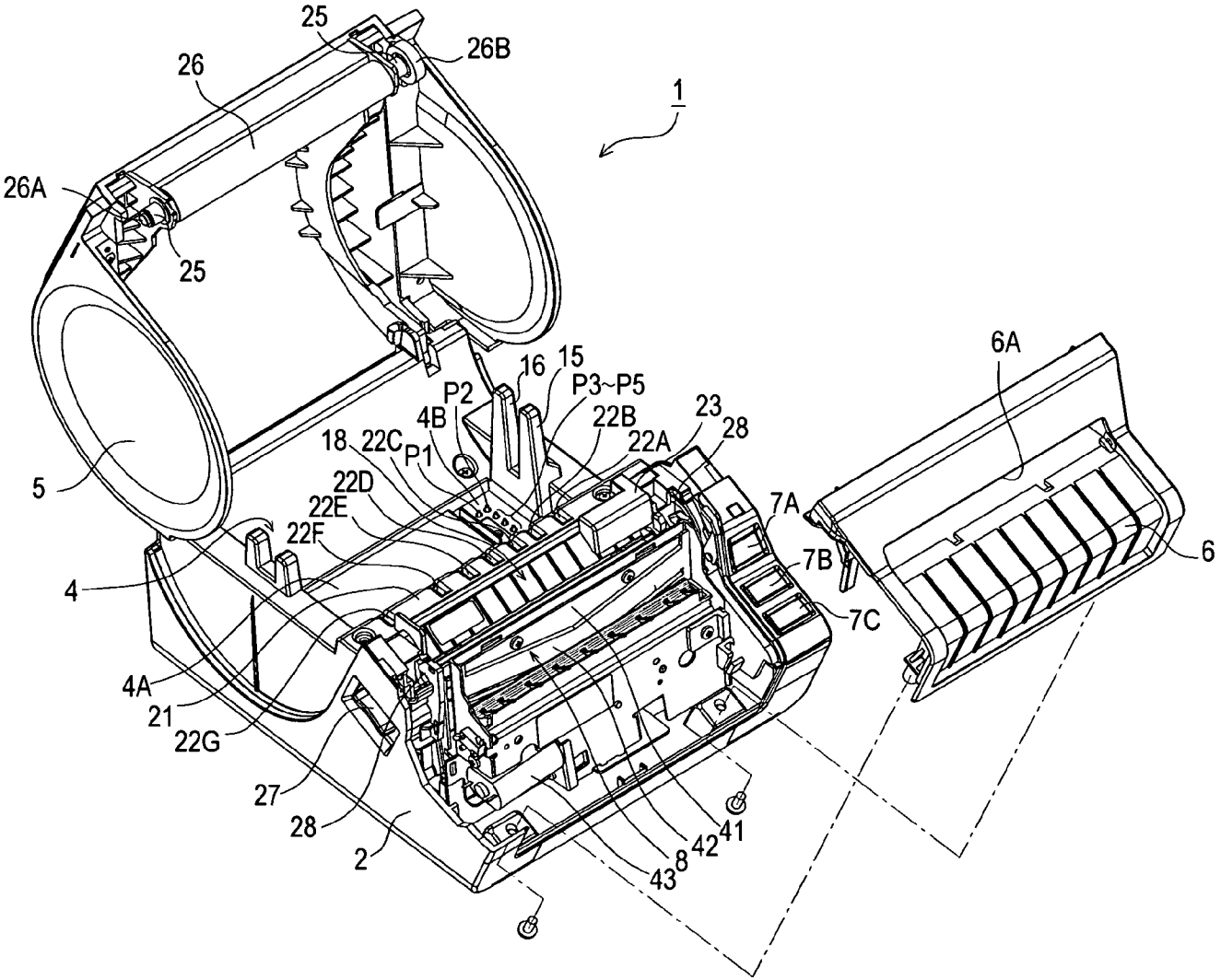
FIG. 6 is a schematic perspective view showing a condition in which a front cover is removed by opening the top cover of the tape printing apparatus as seen from above to the front.

As shown in FIGS. 3, 4 and 6, the tape printing apparatus 1 has a holder supporting member 15 in which an attachment member 13 having a substantially rectangular section which is projected outward of the positioning member 12 constituting the roll sheet holder 3 can be fitted on a side edge portion (right side end portion in FIG. 3) on one side in a substantially perpendicular direction to the carrying direction of the roll sheet holder accommodating portion 4. This holder supporting member 15 includes a first positioning groove portion 16 formed in a substantially longitudinally long U shape in its front view, which is open upward in the width direction and at the same time open to both sides in the width direction.

A loading portion 21 on which the front side top end portion of the guide member 20 constituting the roll sheet holder 3 described later is to be placed is provided such that it is extended substantially horizontally from the rear end portion of an insertion port 18 to which the roll sheet 3A is to be inserted up to the top end portion on the front side of the roll sheet holder accommodating portion 4. Seven second positioning groove portions 22A to 22G having a substantially L-shaped section are formed corresponding to a plurality of width dimensions of the roll sheet 3A on an edge corner portion on the rear side in the carrying direction of this loading portion 21. As shown in FIG. 5, the second positioning groove portions 22A to 22G are formed such that the bottom end portion on the front end to come into contact with the loading portion 21 of the guide member 20 constituting the load sheet holder 3 can be fitted thereto from above.

A positioning concave portion 4A of a rectangular shape with a longer side as seen in its plan view is formed in a predetermined depth (about 1.5 to 3 mm in this embodiment) substantially vertically to the carrying direction from the inside proximal end portion of the holder supporting member 15 up to the proximal end portion of an opposing side face in the bottom portion of the roll sheet holder accommodating portion 4. The carrying direction width dimension of this positioning concave portion 4A is set substantially equal to the width dimension of each of the bottom end portion of the positioning member 12 and the guide member 20 which constitute the roll sheet holder 3. Further, a determining concave portion 4B of a rectangular shape with a longer side along the carrying direction as seen in its plan view is formed so that a portion opposing a sheet determining portion (not shown) extending inward substantially at right angle from the bottom end portion of the positioning portion 12 is deeper than the positioning concave portion 4A by a predetermined depth (a depth of about 1.5 to 3 mm in this embodiment), the same determining concave portion being formed on the proximal end inside of the holder supporting member 15 of the positioning concave portion 4A.

This determining concave portion 4B includes six sheet determining sensors P1, P2, P3, P4, P5, P6 arranged in an L-shape each constituted of push type micro switch or the like in order to determine the type of the roll sheet 3A and material of the heat sensitive sheet 3C, the width of the roll sheet 3A and the like. In the meantime, FIG. 6 indicates five sheet determining sensors P1 to P5.

The sheet determining sensors P1 to P6 are constituted of a known mechanical switch composed of a plunger, micro switch and the like and the top end portion of each plunger is provided to project from the bottom face portion of the determining concave portion 4B up to the vicinity of the bottom face portion of the positioning concave portion 4A. The sheet determining sensors P1 to P6 detect whether or not there is any sensor hole (not shown) formed in a sheet determining portion extending inward substantially at right angle from the bottom end portion of the positioning member 12 so as to detect the type of the roll sheet 3A loaded in the roll sheet holder 3, material of the heat sensitive sheet 3C, width of the roll sheet 3A and the like depending on an ON/OFF signal.

In each sheet determining sensor P1 to P6 of this embodiment, its plunger is projected up to the vicinity of the bottom face of the positioning concave portion 4A from the bottom face of the determining concave portion 4B and the micro switch is kept OFF normally. Then, when the sensor hole in the sheet determining portion is located at a position opposing each of the sheet determining sensors P1 to P6, the plunger is not pressed so that the micro switch is kept OFF and thus, an OFF signal is outputted. On the other hand, if the sensor hole in the sheet determining portion is not located at a position opposing the sheet determining sensors P1 to P6, the plunger is pressed to turn ON the micro switch and then an ON signal is outputted. Thus, the respective sheet determining sensors P1-P6 output 6-bit "0", "1" signals and when the respective sheet determining sensors P1 to P6 are all OFF, namely, no roll sheet holder 3 is mounted, a 6-bit signal of "000000" is outputted.

A side end portion (right end portion in FIG. 3) on the side of a holder supporting member 15 of the insertion port 18 is formed at a position opposing the inside end face of the positioning member 12 to be fitted to the holder supporting member 15. Further, a guide wall face is formed on the side end portion on the side of the holder supporting member 15 of the insertion port 18 such that it is raised up to almost a rear end portion in the carrying direction in the loading portion 21 and a guide portion 23 projecting by a specified width in the width direction is formed to cover the top face portion of the roll sheet 3A and the roll sheet 3A is passed therebelow.

A platen roller 26 is supported rotatably on the bottom side of the front end portion of the top cover 5. A thermal head 31 is fixed to the top face of a head supporting member 32 urged upward by a pressing spring 24. The end portion on the rear side in the carrying direction of this head supporting member 32 is supported swingably in a vertical direction by the rear face portion of the frame 33. A guide portion 34 of a predetermined width (about 15 mm in this embodiment) extending outward is fitted into a guide hole 35 (see FIG. 7) provided in the front face portion of the frame 33 in the center of the end portion on the front side in the carrying direction of the head supporting member 32 such that it can be moved in the vertical direction.

When the top cover 5 is closed, the platen roller 26 depresses the roll sheet 3A against the thermal head 31 urged upward by the pressing spring 24 so as to enable printing to be carried out. Additionally, when the top cover 5 is closed, respective collar members 25, 25 fitted rotatably to the outer periphery of both end portions of a roller shaft 26A of the platen roller 26 are secured by respective pawl portions 28, 28 having a substantially inverted L shape in its side view urged backward in the carrying direction. A gear 26B is fixed at an end portion on the side of the holder supporting member 15 of the roller shaft 26A and when the top cover 5 is closed, it meshes with a gear string (not shown) so that the platen roller 26 can be rotated by a sheet feeding motor (not shown) constituted of a stepping motor or the like.

When release knobs 27, 27 provided on right and left side wall portions of the main body case 2 are pressed upward, the respective engaging pawls 28, 28 are rotated forward in the carrying direction resisting an urging force, so that engagement with each collar member 25 is released. Consequently, the platen roller 26 is urged upward by the thermal head 31 and the top cover 5 is brought slightly upward thereby enabling the top cover to be opened.

A control board 36 having a control circuit portion for controlling driving of each mechanical component according to an instruction from a personal computer outside or the like is provided on the bottom portion of the roll sheet holder portion 4. A power supply board 37 containing a power circuit portion is provided below the frame 33. Then, the control board 36 and the power supply board 37 are covered with a bottom face cover 38 made of thin steel plate (steel plate such as SPCC about 0.5 mm thick in this embodiment) screwed to the bottom face portion.

Consequently, the roll sheet holder 3 on which the roll sheet 3A wound around a core is loaded is mounted detachably on the roll sheet holder accommodating portion 4 by fitting the attachment member 13 of the positioning member 12 into a first positioning groove portion 16 of the holder supporting member 15 and then fitting a bottom end portion of the front end of the guide member 20 into any of second positioning groove portions 22A to 22G so that the bottom end portion of the guide member 20 is fitted into a positioning concave portion 4A and brought into a contact therewith. A sheet determining portion provided on the bottom end portion inside of the positioning member 12 is inserted into a determining concave portion 4B, so as to make it possible to detect whether or not each sensor hole in the sheet determining portion opposing the respective sheet determining sensors P1 to P6 disposed on the determining concave portion 4B exists. That is, the type of the roll sheet 3A loaded on the roll sheet holder 3 can be detected.

With the side edge portion on one side of the roll sheet 3A in contact with the inside face of the guide member 20, the side edge portion on the other side of this roll sheet 3A is brought into a contact with the guide portion 23 provided on the side edge portion of the insertion hole 18 and a inserted into the insertion hole 18, and then when the top cover 5 is closed, printing is enabled.

When the top cover 5 is closed as shown in FIG. 5, the roll sheet 3A is pressed and urged against the line type thermal head 31 urged upward by the pressing spring 24 so that printing is enabled. The platen roller 26 is rotated by the sheet feeding motor (not shown) constituted of a stepping motor or the like and the driving of the thermal head 31 is controlled to carry the roll sheet 3A to print image data on a print face of a heat sensitive sheet 3C in succession. When a cutting position on the rear side in the carrying direction of a printed roll sheet 3A is carried up to a position opposing a fixed blade 41 of the cutter unit 8, as described later, a movable blade 42 shaped in letter V in its front view of the cutter unit 8 is reciprocated in the vertical direction by a cutting motor 43 such as a DC motor (see FIG. 7) so that the roll sheet 3A is cut out (see FIG. 16) by the fixed blade 41 and the movable blade 42 and a cut sheet is discharged from the sheet discharge port 6A.

Next, the schematic structure of the cutter unit 8 will be described with reference to FIGS. 5, 7 to 12. As shown in FIGS. 5, 7 to 12, the cutter unit 8 comprises a rear frame 51 formed in U shape in its plan view which is disposed on the rear side in the carrying direction and on which the fixed blade 41 or the like is fixed, a front frame 52 on which the cutting motor 43 or the like is fixed and which covers the front side in the carrying direction of the rear frame 51.

Figure 7:
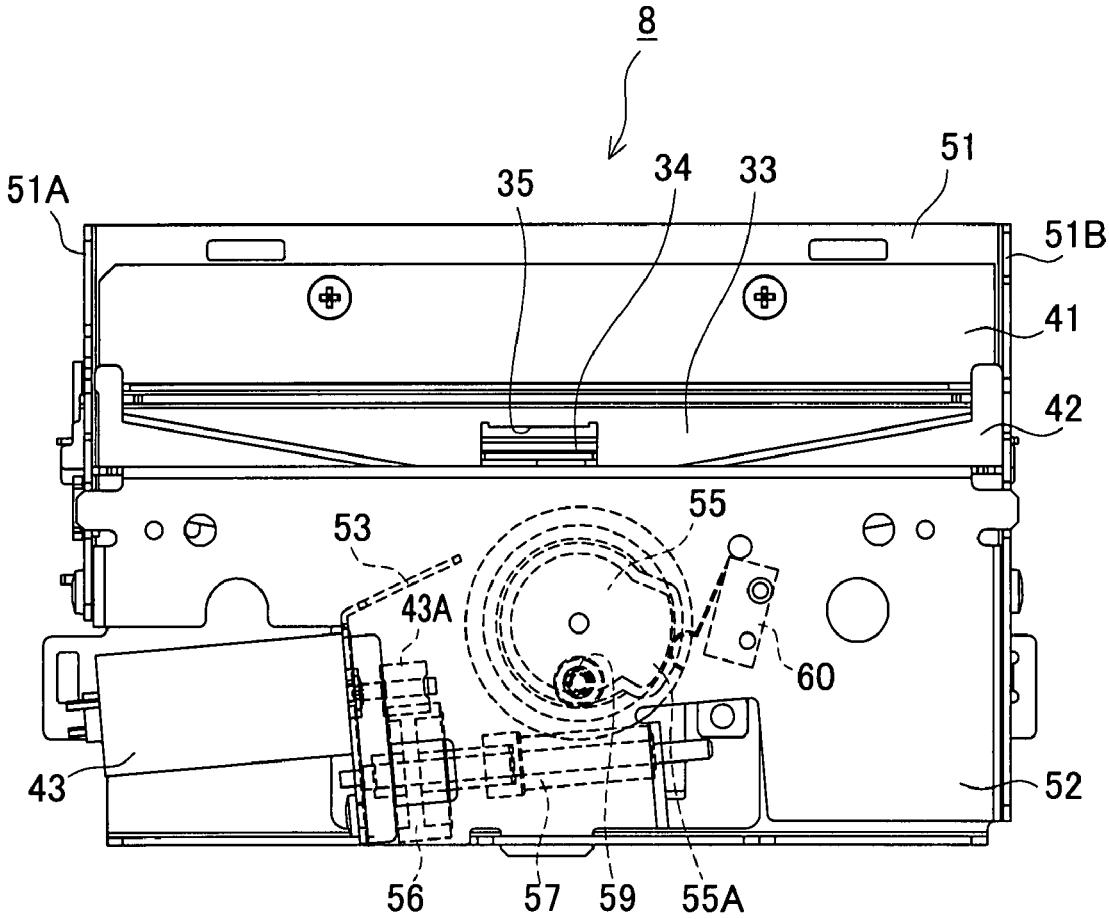
FIG. 7 is a front view of a cutter unit.
Figure 8:
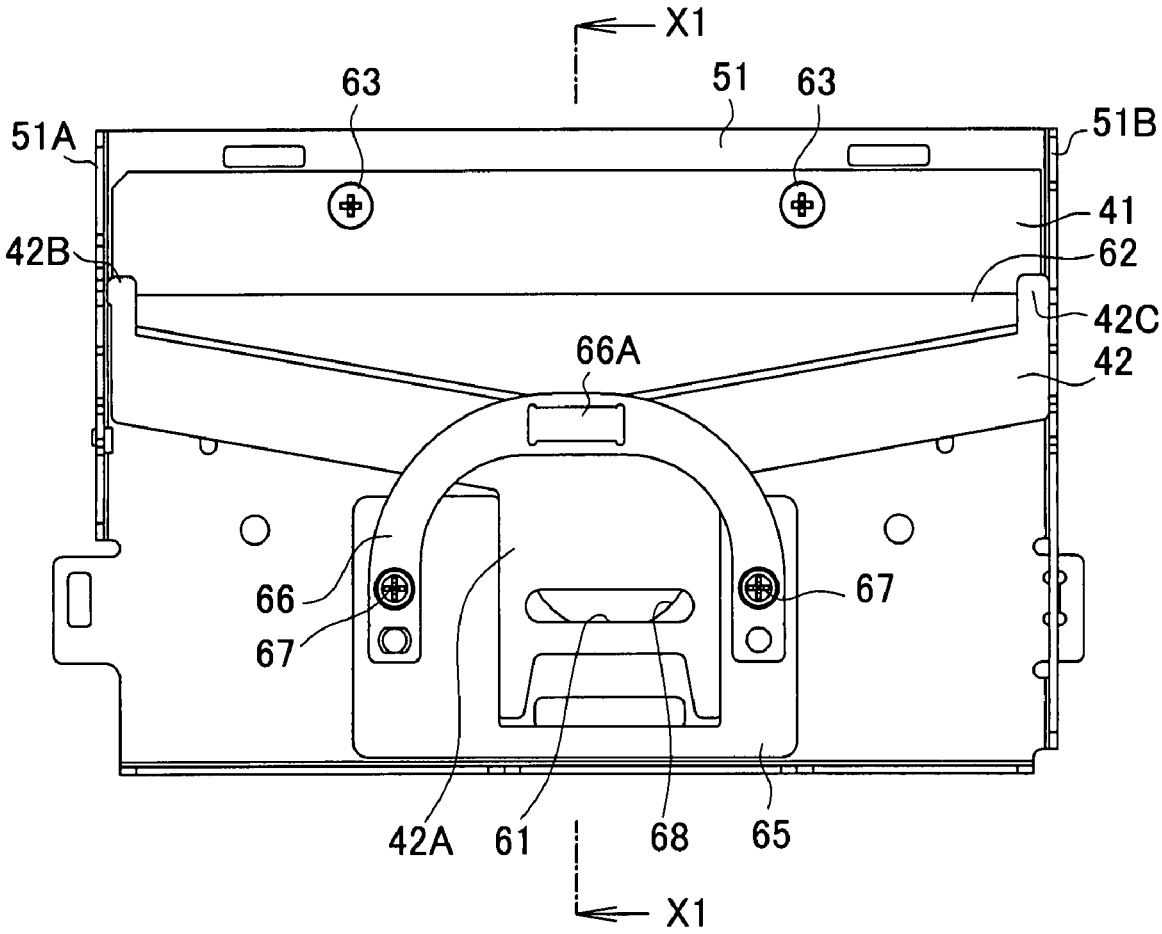
FIG. 8 is a front view showing a condition in which the front frame of the cutter unit is removed.
Figure 9:
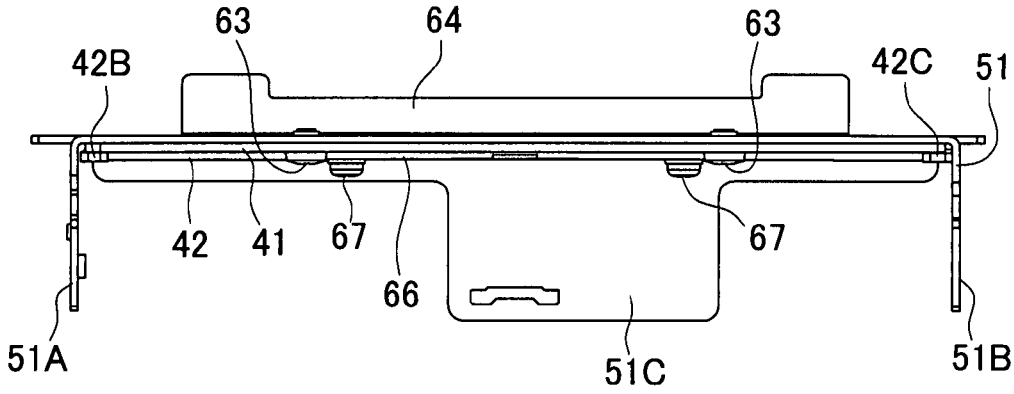
FIG. 9 is a plan view showing a condition in which the front frame of the cutter unit is removed.

As shown in FIGS. 5, 7, the left bottom corner of the front frame 52 in FIG. 7 is cut out and a predetermined length (about 12 mm in this embodiment) thereof is bent in an inward direction substantially at right angle and then, the cutting motor 43 is attached via a motor flange 53. A cam gear 55 is attached rotatably in a substantially central portion of the front frame 52 opposing the movable blade 42. The cam gear 55 is rotated via a pinion gear 43A, a gear 56 and a worm gear 57 mounted on a motor shaft of the cutting motor 43 by the cutting motor 43.

A drive pin 59 fitted into an elongated cam groove 61 (see FIG. 8) provided in a guide portion 42A (see FIG. 8) of the movable blade 42 is provided projectingly in the vicinity of the outer periphery on an end face on the side of the movable blade 42 of the cam gear 55. The front frame 52 has a home position detecting switch 60 for detecting the lowest point of the drive pin 59 erected on this cam gear 55, namely, the position of the home position to the right of the cam gear 55 in FIG. 7. A pressing portion 55A for pressing this home position detecting switch 60 is formed on the outer peripheral portion of the cam gear 55 when the drive pin 59 is located at the lowest point, namely, the position of the home position and capable of detecting that the cam gear 55 is rotated by a single turn from the home position by driving the cutting motor 43. Thus, when the tape printing apparatus 1 is started, the cam gear 55 is located at the home position and set at a position in which the home position detecting switch 60 is pressed via the pressing portion 55A.

As shown in FIGS. 8 to 12, in the rear frame 51 to which the front frame 52 is to be mounted, its right and left end portions are bent substantially at right angle in a forward direction of the carrying direction so as to form left side wall portion 51A and right side wall portion 51B. Further, the bottom edge portion of the rear frame 51 is bent by a predetermined width (about 5 mm in this embodiment) substantially at right angle in a forward direction of the carrying direction and a front frame receiving portion 51C which extends by a predetermined length (about 12 mm in this embodiment) in the forward direction of the carrying direction is formed substantially in the center thereof.

An elongated opening portion 62 through which the roll sheet 3A passes is provided in the rear frame 51. The fixed blade 41 longer than the lateral width of the opening portion 62 is screwed with screws 63, 63 to the top edge portion of the opening portion 62 between the respective side wall portions 51A and 51B on the front side in the carrying direction. The tip of the fixed blade 41 is situated slightly below the top edge portion of the opening portion 62 (below the top edge portion of the opening portion 62 by about 1 mm-1.5 mm in this embodiment) such that it can make contact with an entire width of the roll sheet 3A.

Both right and left end portions of the movable blade 42 are extended upward with a substantially identical width into a gap between the right/left side end portions of the opening portion 62 and the side wall portions 51A, 51B and when the movable blade 42 is situated at the lowest point, namely, the home position, the top end portions ride over both right and left end portions of the fixed blade 41 so as to form respective guide portions 42B, 42C.

Figure 10:
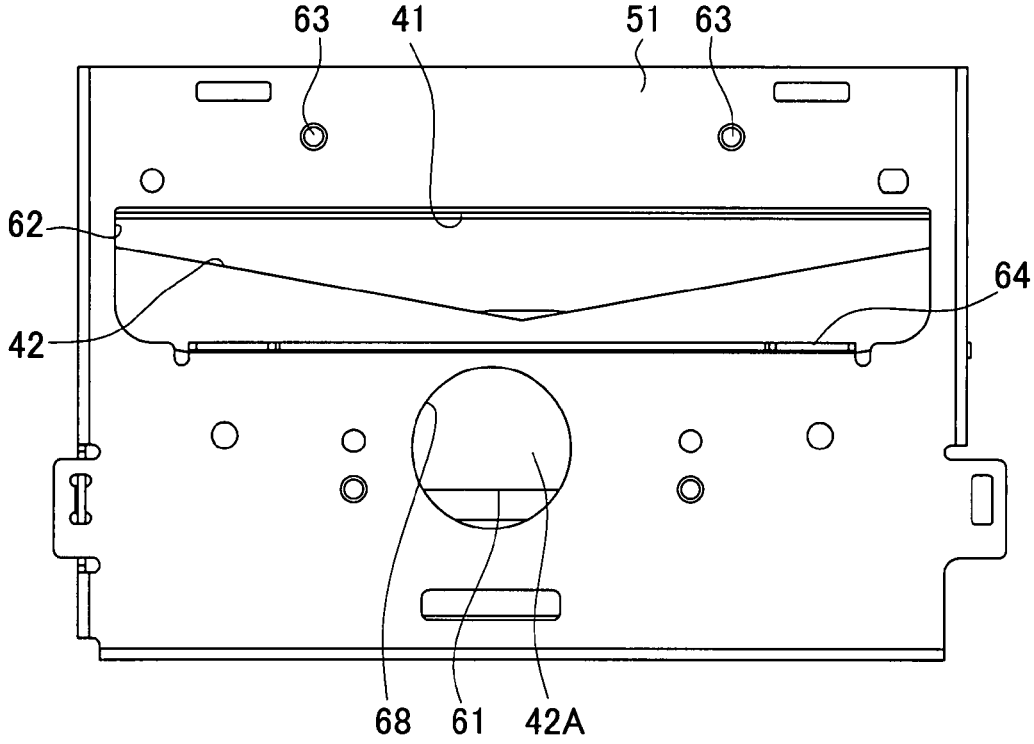
FIG. 10 is a rear view showing a condition in which the front frame of the cutter unit is removed.
Figure 11:
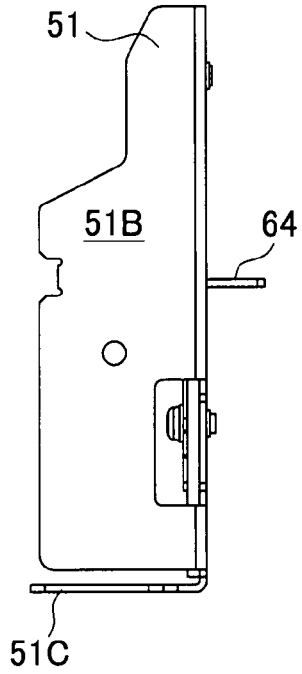
FIG. 11 is a right side view showing a condition in which the front frame of the cutter unit is removed.
Figure 12:
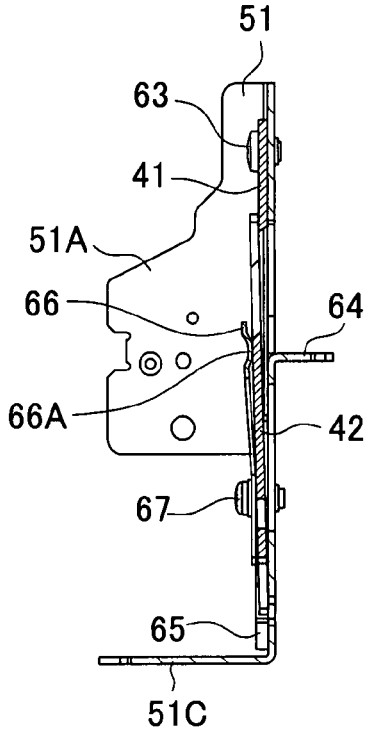
FIG. 12 is a sectional view taken along the line X1-X1 of FIG. 8.

The bottom end portion of the opening portion 62 of the rear frame 51 is located at a position lower by a predetermined length (about 3 mm-5 mm in this embodiment) than the bottommost end portion of the V-shaped tip of the movable blade 42 when the movable blade 42 is situated at the lowest point, that is, the home position (see FIG. 10). Then, when the movable blade 42 is situated at the lowest point, there is formed a gap of a predetermined distance in the vertical direction between the bottommost end portion of the V-shaped tip of the movable blade 42 and the bottom end portion of the opening portion 62. An extending portion 64 which extends backward in the carrying direction substantially at right angle from the bottom edge portion of the opening portion 62 is formed so that it makes contact with the front side face in the carrying direction of the frame 33.

A flat-sheet, U-shaped movable blade guide member 65 which is open upward in its front view is disposed substantially in the center on the front side in the carrying direction below the opening portion 62 of the rear frame 51. Then, the right/left side face portions of a guide portion 42A extending downward from the bottom end portion of the V-shaped movable blade 42 are supported by this movable blade guide member 65 such that they can be reciprocated freely in the thickness direction of the roll sheet 3A. A substantially semi-circular pressing spring 66 is secured to the rear frame 51 together with the guide member 65 with screws 67, 67 such that it can press the front face side of the movable blade 42 along substantially the center line in the right-left direction and the above-mentioned right/left side face portions are supported such that they can be reciprocated in the thickness direction of the roll sheet 3A with the movable blade 42 pressed against the fixed blade 41 side. A convex portion 66A whose side section is substantially semi-circular, projecting backward in the carrying direction is formed at the top end portion of the pressing spring 66 thereby reducing contact resistance of the movable blade 42.

A through hole 68 of a predetermined diameter is provided in a portion opposing the cam groove 61 of the movable blade 42 of the rear frame 51 so that the drive pin 59 fitted into this cam groove 61 can be moved circularly with a rotation of the cam gear 55.

Figure 13:
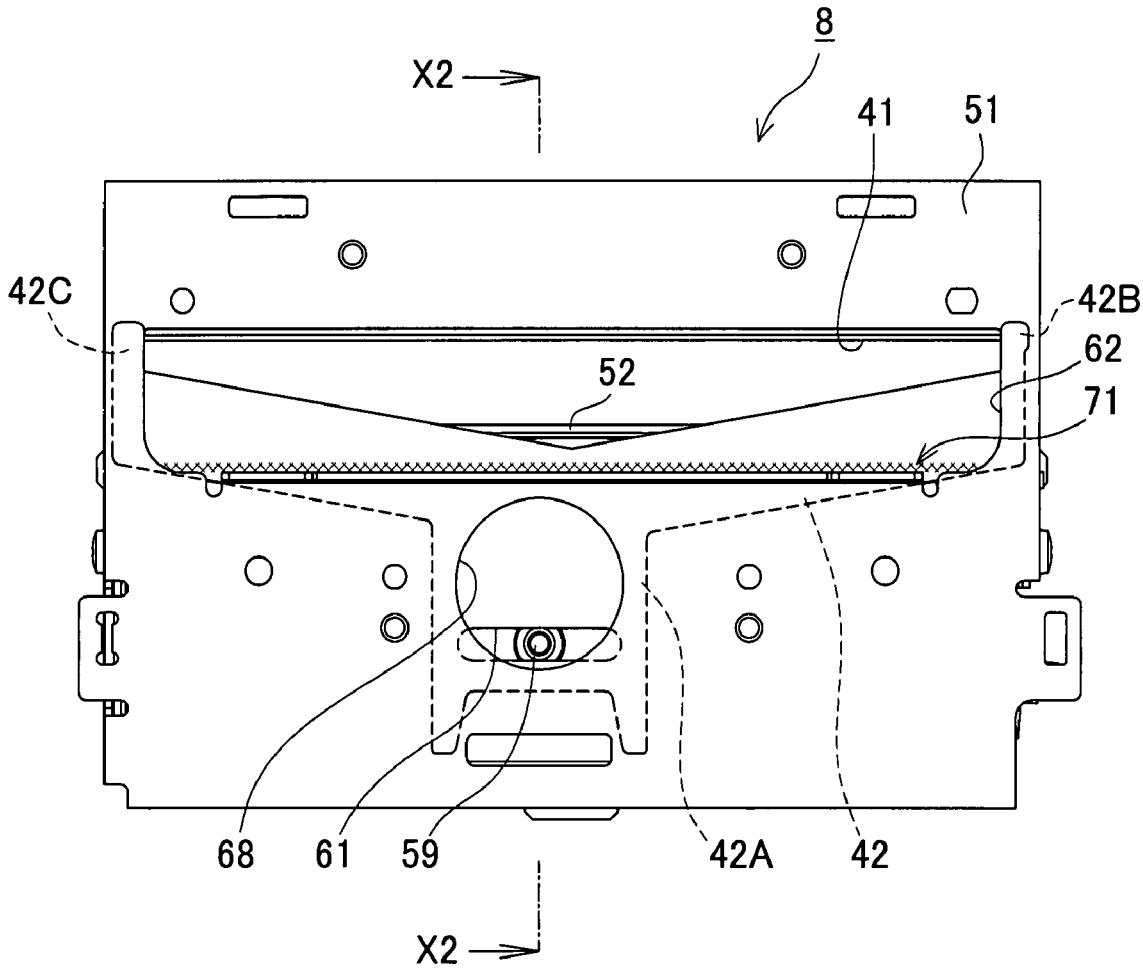
FIG. 13 is a rear view of the cutter unit when cutting of the roll sheet is started, for explaining an activity of the cutter unit.

Cutting of the roll sheet 3A by the cutter unit 8 having the above-described structure will be described with reference to FIGS. 13 to 16. When cutting of the roll sheet 3A is started, as shown in FIGS. 13, 15, the pressing portion 55A of the cam gear 55 is located at the home position which presses the home position detecting switch 60 and the drive pin 59 is located at the lowest point, so that the movable blade 42 is located at the lowest point. The roll sheet 3A printed by the thermal head 31 is carried into the opening portion 62 and with an end portion on the rear side in the carrying direction of the roll sheet 3A pressed by the platen roller 26 against the thermal head 31 so that it is nipped therebetween, the other end portion is projected from the sheet discharge port 6A.

Figure 14:
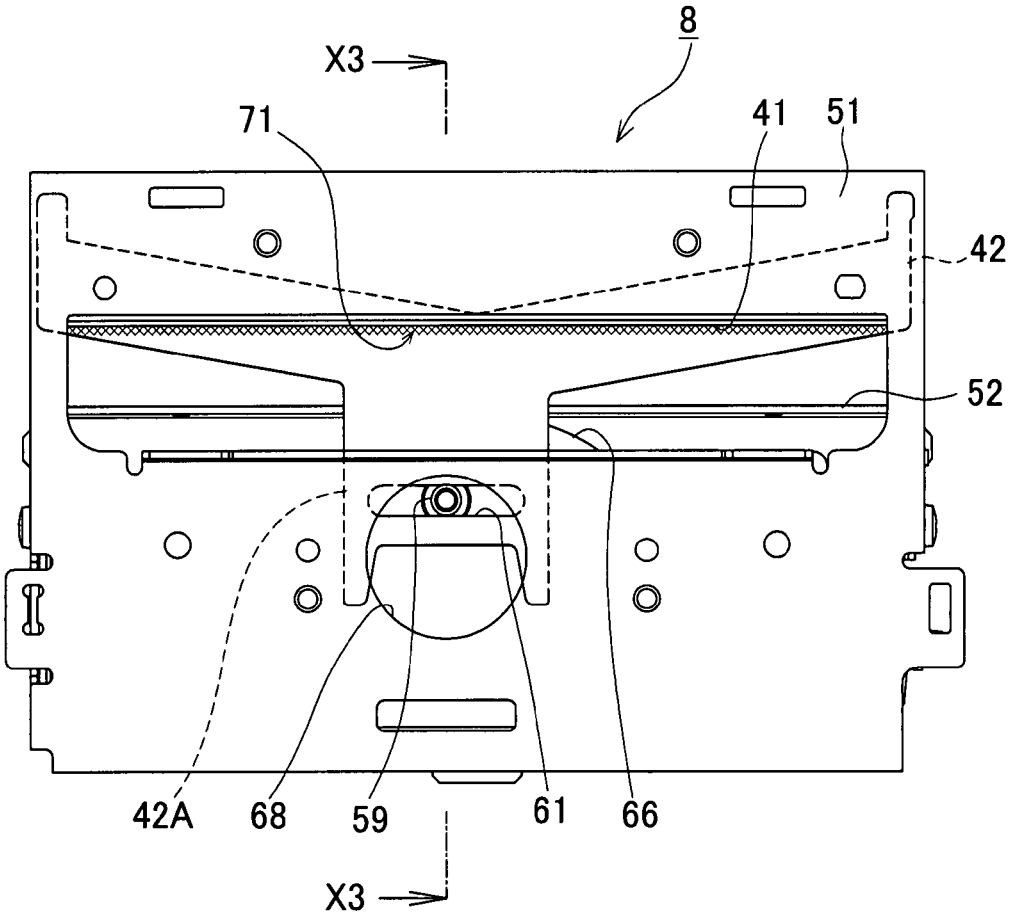
FIG. 14 is a rear view of the cutter unit when the roll sheet is cut, for explaining an activity of the cutter unit.
Figure 15:
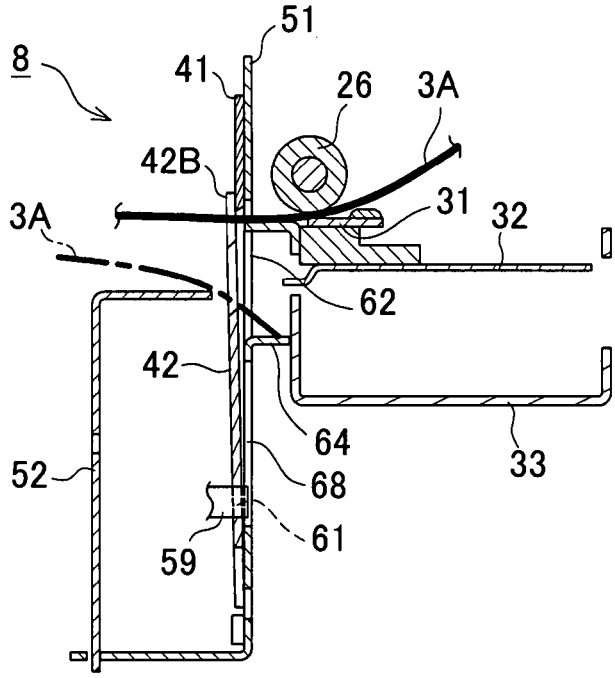
FIG. 15 is a sectional view of major portions, taken along the line X2-X2 of FIG. 13, for explaining a cutting starting time of the roll sheet.
Figure 16:
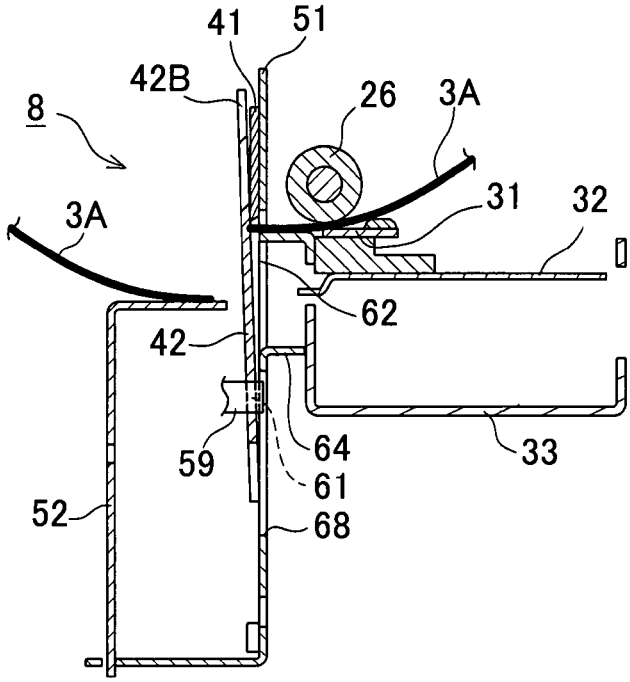
FIG. 16 is a sectional view of major portions taken along the line X3-X3 of FIG. 14, for explaining a cutting time of the roll sheet.

When the cam gear 55 is rotated by 180° from the home position by driving the cutting motor 43 as shown in FIGS. 14, 16, the drive pin 59 is moved to a position at the topmost end while it slides in the cam groove 61 of the movable blade 42, so that the bottommost end portion of the V-shaped tip of the movable blade 42 is moved to above the fixed blade 41. Consequently, the roll sheet 3A carried into the opening portion 62 is cut out throughout the entire width in the width direction. Further, an adhesive agent of an adhesive agent layer 3D of the roll sheet 3A adhering to the tip of the movable blade 42 is moved to a position of a height near the bottommost end portion of the V-shaped tip of the movable blade 42 with sliding between the movable blade 42 and the fixed blade 41, so that an adhesive agent accumulation portion 71 (shaded portion of the movable blade 42 in FIG. 14) in which an adhesive agent is accumulated is formed along the tip of the fixed blade 41.

When the cutting motor 43 is stopped after the pressing portion 55A of the cam gear 55 is rotated until it presses down the home position detecting switch 60 by driving the cutting motor 43, that is, when the cutting motor is stopped after the cam gear 55 is rotated by 360° from the home position, the drive pin 59 is located at the lowest point again as shown in FIGS. 13 and 15, so that the movable blade 42 is located at the lowest point. As described above, the bottom end portion of the opening portion 62 is located at a position lower by a predetermined length (about 3 mm to 5 mm in this embodiment) than the bottommost end portion of the V-shaped tip of the movable blade 42 by a predetermined height. Thus, the adhesive agent accumulation portion 71 formed near the bottommost end portion of the V-shaped tip of the movable blade 42 is located above the bottom end portion of the opening portion 62, so that contact between the adhesive agent accumulation portion 71 and the rear frame 51 can be avoided.

As shown in FIG. 15, an extending portion 64 of the rear frame 51 makes contact with the front side face in the carrying direction of the frame 33. If the cut roll sheet 3A or the like enters the opening portion 62 through the sheet discharge port 6A, it makes contact with this extending portion 64 to prevent it from invading into the tape printing apparatus 1.

Therefore, in the tape printing apparatus 1 of this embodiment, when the roll sheet 3A is cut out, the adhesive agent in the adhesive agent layer 3D of the roll sheet 3A adhering to the movable blade 42 is moved up to a position of height near the bottommost end portion of the V-shaped tip of the movable blade 42 by sliding between the movable blade 42 and the fixed blade 41 and the adhesive agent accumulation portion 71 in which an adhesive agent is accumulated is formed along the tip of the fixed blade 41. When the movable blade 42 is lowered to the position corresponding to the home position at the lowest point, the adhesive agent accumulation portion 71 formed near the bottommost end portion of the V-shaped tip of the movable blade 42 is located above the bottom edge portion of the opening portion 62.

Consequently, the adhesive agent accumulation portion 71 formed at the position of height near the bottommost end portion of the V-shaped tip of the movable blade 42 is always moved in the thickness direction of the roll sheet 3A, namely, in the vertical direction within the opening portion 62. Thus, contact between the adhesive agent accumulation portion 71 and the rear frame 51 can be avoided securely thereby preventing an adhesive agent adhering to the movable blade 42 from causing resistance to sliding with respect to the rear frame 51 with a simple structure. As a result, the durability performance of the cutter unit 8 constituted of the fixed blade 41 and the movable blade 42 or the like can be improved tremendously.

Because the extending portion 64 of the rear frame 51 is kept in contact with the front side face in the carrying direction of the frame 33, when the cut roll sheet 3A or the like enters the opening portion 62 through the sheet discharge port 6A, it comes into contact with this extending portion 64 so that it is prevented from invading into the tape printing apparatus 1.

Needless to say, the present invention is not restricted to the above-described embodiment but may be improved or modified in various ways within a range not departing from the spirit of the invention.

Figure 17:
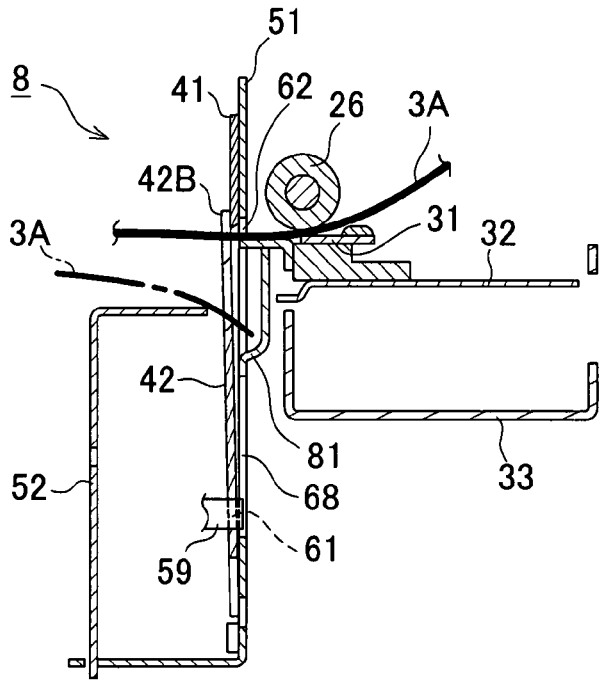
FIG. 17 is a sectional view of major portions taken along the line X2-X2 of FIG. 13, for explaining a cutting starting time of the roll sheet in the tape printing apparatus of other embodiment.
Figure 18:
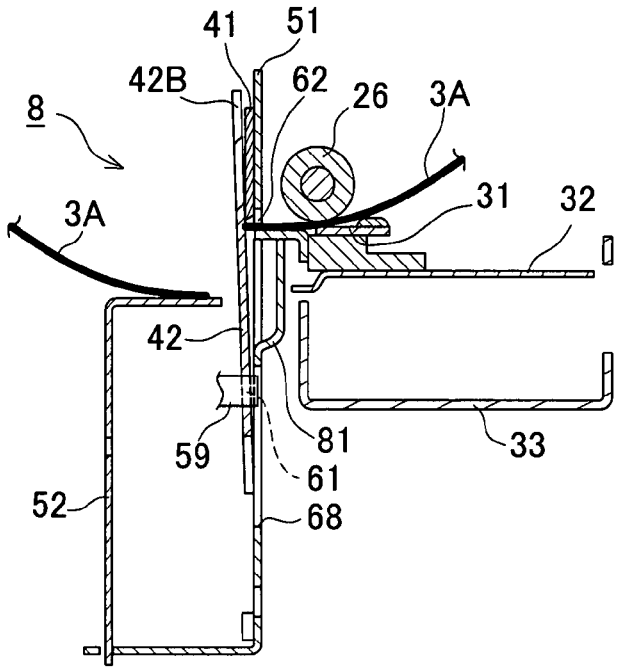
FIG. 18 is a sectional view of major portions taken along the line X3-X3 of FIG. 14, for explaining a cutting time of the roll sheet in the tape printing apparatus of other embodiment.

As shown in FIGS. 17, 18, in the cutter unit 8, the height of the bottom end portion of the opening portion 62 in the rear frame 51 is formed to be situated near the top end portion of the tip of the movable blade 42 and the height in the vertical direction of the opening portion 62 is so set that the roll sheet 3A can pass therethrough. Further, it is permissible to provide an expanding portion 81 which starts expanding from a portion lower by a predetermined length (about 3 to 5 mm in this embodiment) than the bottommost end portion of the V-shaped tip of the movable blade 42 at the home position while keeping a predetermined distance (for example, a distance of about 3 mm to 5 mm) backward in the carrying direction throughout the entire longitudinal direction of the opening portion 62.

Consequently, this expanding portion 81 functions as a keep-off spatial portion and the adhesive agent accumulation portion 71 formed at the position of height near the bottommost end portion of the V-shaped tip of the movable blade 42 always move in the thickness direction of the roll sheet 3A, namely, the vertical direction within the expanding portion 81, so that contact between the adhesive agent accumulation portion 71 and the rear frame 51 can be avoided securely. Consequently, adhesive agent adhering to the movable blade 42 can be prevented from causing resistance to sliding with respect to the rear frame 51 with a simple structure, thereby improving durability performance of the cutter unit 8 constituted of the fixed blade 41 and the movable blade 42 or the like tremendously. When the cut roll sheet 3A or the like enters the opening portion 62 through the sheet discharge port 6A, it makes contact with this expanding portion 81 so that it can be blocked from invading into the tape printing apparatus 1.

In the disclosed tape printing apparatus, it is preferable that the keep-off spatial portion contains a window portion formed by cutting out a side edge portion on the side of the movable blade in the roll sheet insertion port by a predetermined width in a moving direction of the movable blade.

In the disclosed tape printing apparatus, it is preferable that the side edge portion on the side of the movable blade in the window portion is formed to oppose a portion outside in the moving direction of the movable blade, relative to a sliding portion between the movable blade and the fixed blade when the movable blade reaches a position most apart from the fixed blade.

In the disclosed tape printing apparatus, it is preferable that the window portion has an extending portion extending to an insertion side in a roll sheet insertion direction from the side edge portion on the side of the movable blade, the extending portion being so constructed that when a cut roll sheet invades from the window portion, the cut roll sheet comes into contact therewith.

In the disclosed tape printing apparatus, it is preferable that the keep-off spatial portion has an expanding portion which starts expanding from a position lower by a predetermined length than an end of a sliding portion of the movable blade in a state of drawing back most apart from the fixed blade in the frame member and reaches the bottom side edge portion of the roll sheet insertion port, expanding by a predetermined distance toward the upstream side in a carrying direction of the roll sheet throughout an entire width of the roll sheet insertion port.

In the tape printing apparatus of the disclosure, if the keep-off spatial portion contains the window portion formed by cutting out the side edge portion on the side of the movable blade in the roll sheet insertion port by a predetermined width in the moving direction of the movable blade, when the movable blade is reciprocated on the frame member, adhesive agent adhering to the movable blade can be prevented from causing resistance to sliding with a simple structure.

In the tape printing apparatus of the disclosure, the side edge portion on the side of the movable blade in the window portion may be formed to oppose a portion outside in the moving direction of the movable blade, relative to a sliding portion between the movable blade and the fixed blade when the movable blade reaches a position most apart from the fixed blade. Consequently, even when adhesive agent adhering to the movable blade is accumulated on the edge portion of the sliding portion by sliding between the movable blade and the fixed blade, adhesive agent adhering to the movable blade can be prevented from causing resistance to sliding with respect to the frame member securely, because the side edge portion on the side of the movable blade in the window opposes a portion outside in the moving direction of the movable blade relative to the sliding portion in which the adhesive agent is accumulated.

In the tape printing apparatus of the disclosure, the window portion may have an extending portion extending to an insertion side in the roll sheet insertion direction from the side edge portion on the side of the movable blade, the extending portion being so constructed that when a cut roll sheet invades from the window portion, the cut roll sheet comes into contact therewith. Consequently, when the cut roll sheet enters into the window portion by mistake, it comes into contact with this extending portion, so that it can be prevented from invading into the tape printing apparatus.

In the tape printing apparatus of the disclosure, the keep-off spatial portion may be so constructed that a part of the keep-off spatial portion starts expanding from a position lower by a predetermined length than an end of a sliding portion of the movable blade in a state of drawing back most apart from the fixed blade in the frame member and reaches the bottom side edge portion of the roll sheet insertion port, expanding by a predetermined distance toward the upstream side in a carrying direction of the roll sheet through out an entire width of the roll sheet insertion port. Consequently, even when an adhesive agent adhering to the movable blade is accumulated on the edge portion of the sliding portion by sliding between the movable blade and the fixed blade, the adhesive agent accumulated on the side edge portion of this sliding portion can be prevented from causing resistance to sliding relative to the frame member, because the expanding portion of the frame is expanded by a predetermined distance to the upstream side in the carrying direction of the roll sheet.

While the presently exemplary embodiment has been shown and described, it is to be understood that this disclosure is for the purpose of illustration and that various changes and modifications may be made without departing from the scope of the disclosure as set forth in the appended claims.

What is claimed is:

1. A tape printing apparatus comprising:

a cutting device for cutting a long size roll sheet which contains a printing object medium;

an adhesive agent layer provided on a non-printing object face of the printing object medium and a peeling layer which covers the adhesive agent layer;

wherein the cutting device comprises:

a fixed blade having a lower edge which contacts an entire width of one surface of the long size roll sheet;

a frame member in which the fixed blade is fixed;

an elongated opening portion in the frame member which opposes the fixed blade, and through which the long size roll sheet passes, the opening portion having lower and upper edges and the fixed blade lower edge being adjacent to the opening upper edge;

a movable blade configured to slide against the frame member and against the fixed blade; and the movable blade having a cutting edge with a lower cutting tip, the cutting edge contacting another surface of the long size roll sheet when the movable blade moves vertically toward the fixed blade, so that vertical movement of the movable blade cuts the long size roll sheet throughout the entire width; and a movable blade driving device for reciprocating the movable blade on the frame member between a lower home position and an upper cutting position, such that:

when the lower cutting tip of the movable blade is in the cutting position, the lower cutting tip of the movable blade is located above the opening upper edge and the fixed blade lower edge, so that accumulated adhesive is positioned off of the movable blade cutting edge; and when the lower cutting tip of the movable blade is in the home position, the lower cutting tip of the movable blade is above the opening lower edge, so that accumulated adhesive on the movable blade remains above the opening lower edge.

2. The tape printing apparatus according to claim 1, wherein:

the elongated opening portion has an extending portion extending in a roll sheet insertion direction from the frame, adjacent to the opening lower edge, so that an opposing end of the extending portion connects with a wall face which opposes the frame member, preventing discharged cuttings from entering the apparatus.

3. The tape printing apparatus according to claim 1, wherein:

the elongated opening portion has an expanding portion which expands, from the opening lower edge, toward the fixed blade by a predetermined height throughout an entire width of the elongated opening portion, while being distanced from the movable blade in the roll sheet insertion direction, for receiving accumulated adhesive during the cutting process.

* * * * *